United States Patent [19]

Butts et al.

[11] 4,211,443

[45] Jul. 8, 1980

[54] ELECTRIC STRIKE

[75] Inventors: Lawrence D. Butts; Raymond V. Kambic, both of Joliet, Ill.

[73] Assignee: Folger Adam Co., Division of Telkee, Inc., Joliet, Ill. ; a part interest

[21] Appl. No.: 870,087

[22] Filed: Jan. 17, 1978

[51] Int. Cl.[2] ..... E05B 15/02

[52] U.S. Cl. ..... 292/341.16; 70/277

[58] Field of Search ..... 292/78, 341.16, 341.17, 292/341.15, 201, 144, DIG. 43, 216; 70/277, 280, 281, 282, 450, 252; 200/61-64

[56] References Cited

U.S. PATENT DOCUMENTS

| | | | |
|---|---|---|---|
| 1,880,850 | 10/1932 | Dautrick | 292/341.16 X |
| 3,211,850 | 10/1965 | Toepfer | 200/61.64 |
| 3,640,560 | 2/1972 | Zawadzki | 292/201 X |
| 3,774,422 | 11/1973 | Hogan | 292/341.16 X |
| 4,015,869 | 4/1977 | Horvath | 292/341.16 |

FOREIGN PATENT DOCUMENTS

| | | | |
|---|---|---|---|
| 46394 | 5/1888 | Fed. Rep. of Germany | 292/341.16 |

*Primary Examiner*—J. Franklin Foss

*Attorney, Agent, or Firm*—Clarence A. O'Brien; Harvey B. Jacobson

[57] ABSTRACT

An electric strike having a pivotally mounted keeper for engagement by a door lock bolt or the like having a solenoid control, pivotally mounted locking lever and a pivotally mounted locking cam associated with the lever for releasably retaining the lever in blocking relationship to an abutment on the keeper for releasably retaining the keeper in position for engagement by the door lock bolt, thereby enabling the electric strike to be remotely controlled and operated. The locking lever and locking cam are provided with arcuately curved engaging surfaces which precludes the possibility of the locking cam surface being "walked" off of the locking lever by exerting pressure on the keeper while tapping or otherwise impacting the adjacent structure. The curved engaging surfaces of the locking cam and locking lever reduces wear. The solenoid is oriented externally of the casing and can be oriented in different relationships to the casing for installation in various types of doorjambs. Also, the solenoids may be oriented optionally to provide optional failsafe arrangements and the casing is provided with a plastic insert, such as nylon, which serves as a strain relief for the electric wires extending to the solenoid, signal switches, and the like.

7 Claims, 7 Drawing Figures

ELECTRIC STRIKE

BACKGROUND OF THE INVENTION

1. Field of the Invention

The present invention generally relates to an electric strike for assembly in a door frame with a pivotal keeper being oriented in position for engagement by a door lock bolt for retaining a door in locked position with the keeper being solenoid controlled and releasably locked in place by a pivotal locking lever and pivotal locking cam with the lever and cam having curved engaging surfaces and the locking cam being operated by movement of a solenoid core with various optional arrangements being provided to enable the strike to satisfy various installational requirements.

2. Description of the Prior Art

Electric strikes mounted on door frames and associated with lock bolts on doors are well known with the strikes being provided with a solenoid actuated mechanism in order to selectively release the keeper for pivotal movement so that the door can be released from a remote location by releasing the keeper rather than moving the door lock bolt. U.S. Pat. No. 3,211,850 discloses such an electric strike and the assignee of this application has been actively engaged in the manufacture of electric strikes in accordance with the aforementioned patent for a number of years. U.S. Pat. No. 3,910,617 discloses several embodiments of an electric strike with both patents disclosing arrangements for releasing or actuating the pivotal keeper so that it can selectively retain a door or the like in closed position. While previously known strikes have been used extensively, certain components thereof are subject to wear and, in some instances, the locking components have been disengaged by exerting pressure against the pivotal keeper while impacting or tapping on adjacent surfaces with the vibrations sometimes causing the locking surface to move in relation to each other or "walk" in relation to each other sufficiently to become disengaged thus enabling the keeper to pivot and thus release the door.

SUMMARY OF THE INVENTION

An object of the present invention is to provide an electric strike adapted to be mounted in various types of door frames, stiles, and the like, for association with a door lock bolt, catch, or the like, in which the strike is provided with a pivotal keeper releasably secured in locked position by a solenoid controlled, pivotally mounted locking lever and locking cam assembly having arcuately curved engaging surfaces.

Another object of the invention is to provide an electric strike in which the solenoid for controlling the pivotal keeper is disposed externally of a one-piece cast housing or casing in various orientations to render the strike capable of installation in various space limitations and enabling installation of the strike in door frames or stiles having a standard cut out provided therein.

A further object of the invention is to provide an electric strike in accordance with the preceding objects including an insert providing a strain relief for electric wires associated with the strike.

Still another object of the present invention is to provide an electric strike having optical fail-safe arrangements.

A still further important feature of the present invention is to provide an electric strike in accordance with the preceding objects in which the arcuately curved surfaces generally coincide with the arcuate path of movement of the portion of the locking cam which engages the locking lever, thereby reducing wear of the engaging surfaces with the arcuate surface on the locking lever including an inner end disposed closer to the longitudinal center line of the locking lever as compared with the outer end of the arcuate surface thereby preventing the arcuate surfaces from being disengaged by "walking" movement of the surfaces in relation to each other which sometimes can be accomplished by exerting pressure on the pivotal keeper and thus on the locking lever while tapping or otherwise impacting adjacent surfaces of the door, door frame, and the like.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENTS

Figure 1:
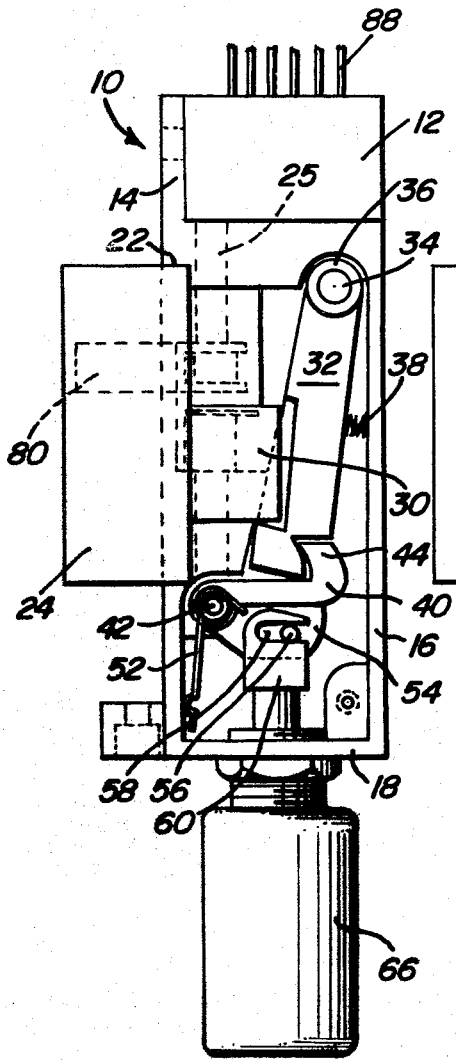
FIG. 1 is a side elevational view of the electric strike illustrating the specific structure of the locking lever and locking cam when in their engaged position with the locking lever blocking movement of the pivotal keeper.
Figure 2:
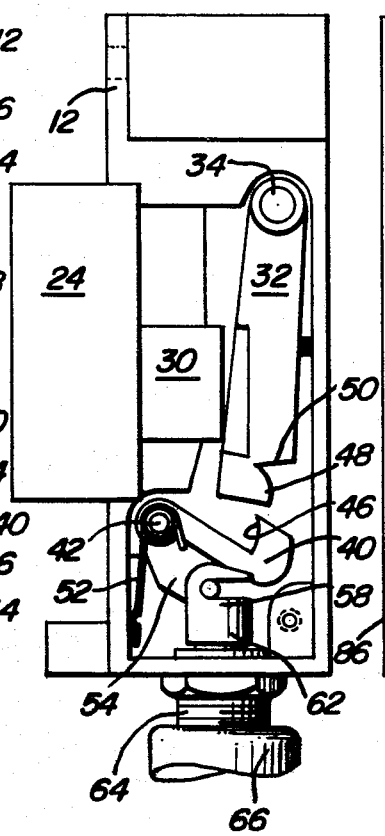
FIG. 2 is a view similar to FIG. 1 but illustrating the locking cam in the released position and the locking lever disengaged from the pivotal keeper.
Figure 3:
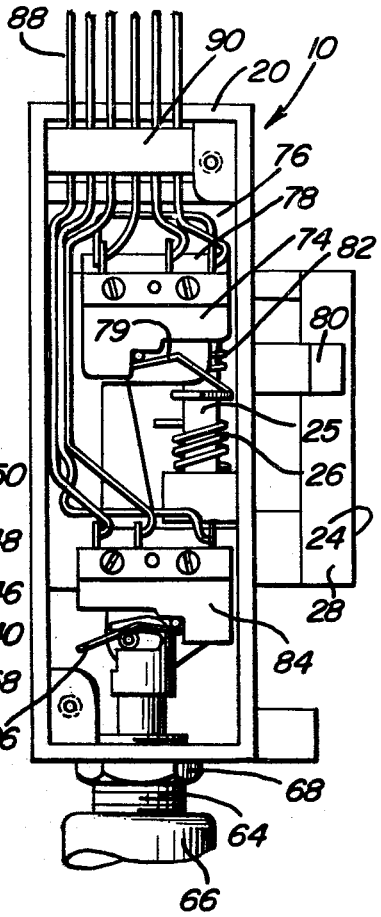
FIG. 3 is a side elevational view of the electric strike illustrating the reverse side of the strike as compared to FIG. 1 with the strain relief insert illustrated in operative association with the electric wires.

Referring now specifically to FIGS. 1–3, the electric strike of the present invention is generally designated by numeral 10 and which includes a casing 12 of one-piece, cast construction which includes an outer wall 14, an inner wall 16, a bottom wall 18 and a top wall 20 with the front wall 14 including an opening 22 through which projects a pivotal keeper 24 mounted on a vertically extending latch keeper pin 25. An axial keeper spring 26 encircles the pin 25 with one end engaging the casing 12 and the other end engaging the keeper 24 to spring bias the keeper 24 to an outwardly projected position so that it projects through the front wall 14 and a face plate (not shown) attached to the front wall 14 by suitable screw threaded fasteners so that a lock bolt, latch bolt, or the like, on a door will engage the convex surface of the keeper 24 which faces the normally inclined surface on a latch bolt or lock bolt as the door swings to a closed position for operation in the usual manner, so that the lock bolt or latch bolt will engage the generally flat surface 28 of the keeper 24.

The keeper 24 is provided with a projection 30 disposed interiorly of the casing 12 and extending to the opposite side of the keeper pin 25 with the projection 30 defining an abutment engaged by or blocked by a locking lever 32 which is pivotally mounted at the upper end portion of the casing 12 by a locking lever pin 34 which is perpendicular to the keeper pin 25 and located above the projection 30 so that the locking lever 32 may pivot to a position out of blocking relationship to the projection 30 as illustrated in FIG. 2, thereby permitting the keeper 24 to pivot about the keeper pin 25 against the resilient bias of the keeper spring 26. This enables the keeper 24 to pivot about the keeper pin 25 when opening force is exerted on the door, thus releasing the lock bolt or latch bolt since the keeper spring 26 will normally keep the keeper in extended position but will enable it to swing to a retracted position when lateral force is exerted on the surface 28. A bushing, such as a brass bushing, or the like, 36 is provided on the locking lever pin 34 to provide for long wearing characteristics and accurate positioning characteristics for the locking lever 32. The projection 30 is generally in the form of a cam surface so that it will tend to pivot the locking lever to an out-of-the-way position against the spring bias of locking lever spring 38 when the lower end of the locking lever is free to swing.

To lock the lower end of the locking lever 32 in blocking position in relation to the projection 30 on the keeper 24, a locking cam 40 is pivotally mounted on the lower front portion of the casing 12 by a locking cam pin 42 which is parallel to the locking lever pin 34 and perpendicular to the keeper pin 25. The locking cam 40 includes an upwardly projecting, generally hook-shaped end portion 44 having a concave, arcuately curved inner surface 46 which engages a similarly curved convex arcuate surface 48 on the lower end of the locking lever 32. The upper end edge of the hook-shaped end 44 is generally flat and is received in a notched lower end 50 on the lower end of the locking lever 32 as illustrated in FIGS. 1 and 2. The locking cam 40 is spring biased so that the free hook-shaped end 44 thereof is biased upwardly by an axial coil spring 52 encircling the locking cam pin 42 with one end engaged with the locking cam 40 and the other end engaged with the interior of the casing 12, as illustrated in FIG. 1, thereby spring biasing the locking cam 40 into locking engagement with the locking lever 32 thereby releasably retaining the locking lever in blocking relationship to the projection 30 thereby preventing pivotal movement of the keeper 24 toward a position which would release a lock bolt, latch bolt, or the like.

The lower portion of the locking cam 40 is provided with a plate 54 having a roll pin 56 extending therethrough with the roll pin 56 being generally parallel to the locking cam pin 42. The roll pin 56 is received in a horizontally disposed slot 58 formed in the upper end portion of a yoke 60 mounted on the upper end of a reciprocal solenoid core 62 which extends into a threaded mounting sleeve 64 and into a solenoid 66 which is rigidly affixed to the threaded sleeve 64 and is attached to and through the lower end wall 18 of the casing 12 by a screw threaded connection with a lock nut 68 being mounted on the sleeve 64 exteriorly of the casing 12 so that the position of the solenoid can be adjusted by loosening the nut 68 and subsequently tightening it in adjusted position. The roll pin 56 can move in the elongated horizontal slot 58 so that as the core 62 is retracted toward the position illustrated in FIG. 2, the downward force exerted on the roll pin 56 will cause the locking cam 40 to pivot downwardly about locking cam pin 42 to its released position as illustrated in FIG. 2 in which position the roll pin 56 is in the inner, closed end of the slot 58, the other end of the slot being open as illustrated.

This structure enables remote energization of the solenoid 66 for disengaging the curved surface 46 on the locking cam 40 from the curved surface 48 on the locking lever 32. This enables the keeper 24 to pivot to a lock bolt releasing position when a force is exerted on the door and door bolt against the keeper 24 with the projecting portion of the keeper 24 pivoting inwardly so that it generally becomes aligned with the front wall 14 or a face plate attached to the front wall 14 of the casing 12.

Figure 4:
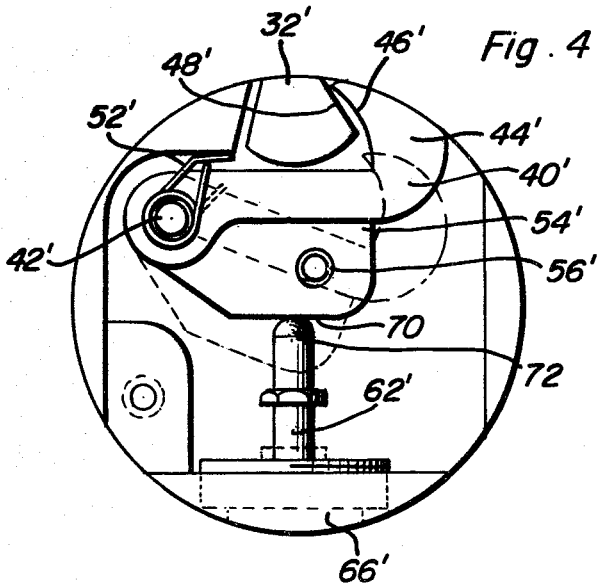
FIG. 4 is a fragmental elevational view illustrating an optional association of the blocking cam in which the solenoid, when energized, retains the locking cam in engagement with the locking lever.

FIG. 4 illustrates a fail-safe arrangement in which the strike enables opening of the door in the event of loss of electrical power. In this embodiment, the locking cam 40' is spring biased to locking engagement with the locking lever 32' since the locking cam 40' is spring biased by a spring 52' which is associated with the locking cam pin 42' and the casing in such a manner to spring bias the outer end of the locking cam 40' downwardly or in a clockwise direction as observed in FIG. 4 thereby releasing the locking cam 40' from the locking lever 32' unless it is retained in the operative position as illustrated in FIG. 4. The bottom edge 70 which is relatively straight on the plate 54' is engaged by the rounded upper end 72 of the solenoid core 62' and as long as the solenoid 66' is energized and the core 62' is extended, it will retain the locking cam 40' in locking engagement with the locking lever 32', but when the solenoid 66' is deenergized for any reason whatsoever, the core 62' will be retracted since it is spring biased inwardly in relation to the solenoid, thus enabling the locking cam 40' to move to a disengaged position. Thus, even if power supply to the solenoid is interrupted inadvertently or due to power failure for any reason whatsoever, the strike will be unlocked so that the keeper can be retracted when opening forces are exerted against a door or the like.

Figure 5:
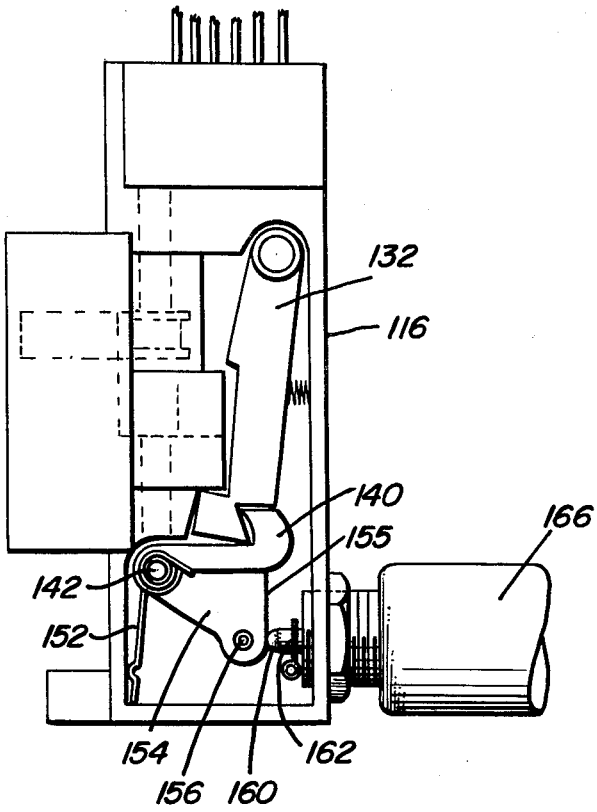
FIG. 5 is a side elevational view of an embodiment of the invention in which the solenoid is oriented in horizontal position and disengages the locking cam upon energization.
Figure 6:
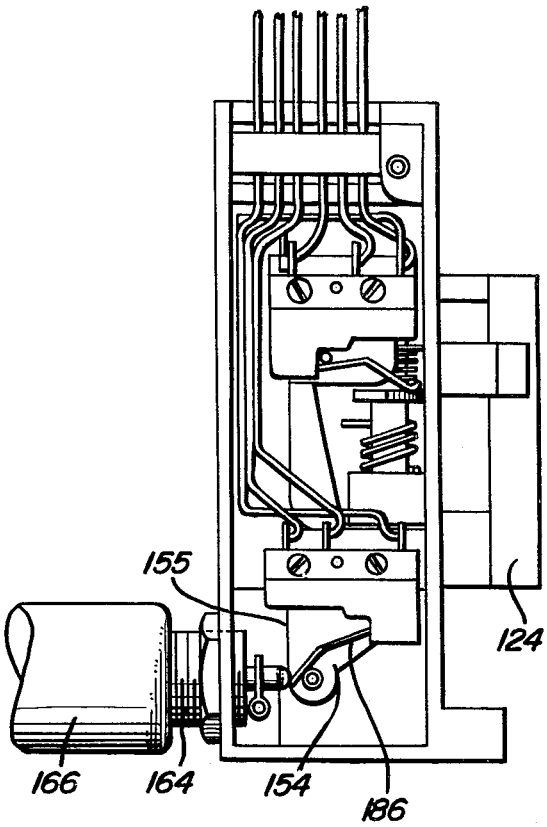
FIG. 6 is a side elevational view of the embodiment of the invention illustrated in FIG. 5 illustrating the reverse side thereof as compared with FIG. 5.

FIGS. 5 and 6 illustrate another embodiment of the electric strike in which all of the components are the same as in FIGS. 1–3, except for the locking cam and the solenoid and plunger arrangement. In this embodiment, the locking cam 140 is provided with a plate 154 which has a greater vertical dimension than plate 54 and is generally triangular in shape with the roll pin 156 being adjacent the lower end thereof and the edge of the plate 154 opposite to the locking cam pin 142 is elongated and straight as indicated by numeral 155. The locking cam 140 pivots about the pin 142 and is biased by the spring 152 to an engaged position with the locking lever 132 performing in exactly the same manner as the locking lever 32 in FIGS. 1–3 and the remainder of the structure associated with the keeper, locking lever and casing remain the same. The solenoid 166 is oriented in perpendicular relation to the longitudinal axis of the casing and is attached to the wall 116 in the same manner that the solenoid 66 is attached to the wall 18. The solenoid 166 includes a plunger or core 162 having a rounded end 160 thereon which is engaged with the vertical edge 155 of the cam plate 154 at a point below the pin 142 so that when the core 162 is moved or pushed outwardly of the solenoid 166 when the solenoid is energized, the locking cam 140 will be pivoted downwardly or in a clockwise direction about the pin 142 thus releasing the locking cam 140 from the locking lever 132 in the same manner as the operation of the structure illustrated in FIGS. 1–3.

Figure 7:
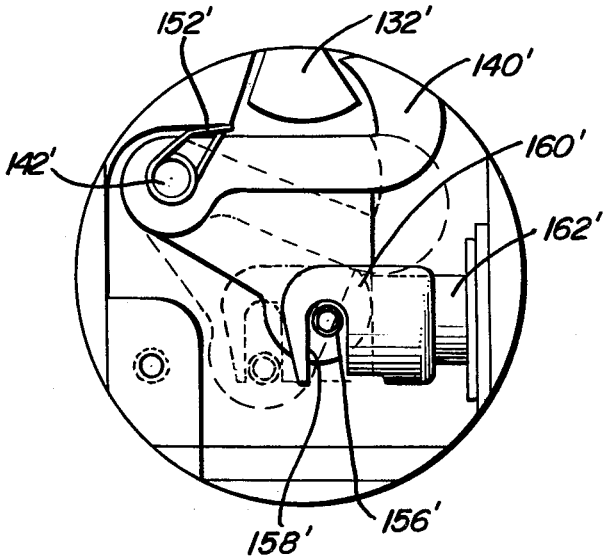
FIG. 7 is a fragmental elevational view illustrating an optional arrangement in which the locking cam is retained in engaged relation with the locking lever when the solenoid is energized.

FIG. 7 illustrates a fail-safe embodiment of the invention illustrated in FIGS. 5 and 6 in which all of the structure is identical, except for the plunger 162' having a yoke 160' with a slot or notch 158' therein positioned over and receiving the roll pin 156' with the core 162' being pulled inwardly in relation to the solenoid when energized so that the locking cam 140' will be retained in engagement with the locking lever 132' against the bias of the fail-safe locking cam spring 152' which is associated with the pin 142' in a manner to bias the locking cam 140' to its released, broken line position illustrated in FIG. 7. Thus, if the power supply to the solenoid in the embodiment of FIG. 6 is interrupted for any reason, the electric strike will be released or unlocked by the spring 152' moving the locking cam 140' to a position disengaged from the locking lever 132'.

Both embodiments of the invention are provided with a latch bolt monitor switch 74 mounted on a switch mounting plate 76 and an insulating pad 78 with the switch 74 including a finger or actuator 79 engaged by the switch tripper 80 pivotally mounted on the keeper pin 25 and biased to a position out of engagement with the finger 79 by switch tripper spring 82. The signal switch tripper 80 is disposed adjacent the flat surface 28 of the keeper 24 in a position for engagement by the door lock bolt thereby monitoring and indicating at a remote location the position of the position of the door lock bolt. Also, the lower end of the electric strike is provided with a monitoring switch 84 indicating the position of the locking cam 40 with the switch 84 including a finger or actuator 86 extending alongside of the cam plate 54 and in a position for engagement by the roll pin 56, so that as the roll pin is reciprocated between its two extreme positions, it will actuate the switch 84 in order to monitor and indicate at a remote location the specific orientation of the locking cam 40 thereby indicating the condition of the electric strike.

Also, both embodiments of the invention include insulated electrical wires 88 connected with the switches 74 and 84 and the solenoid 66 and extending from the upper end of the casing 12. In order to secure the electric wires 88 in relation to the casing 12, an insert 90 of plastic material, such as nylon, is provided in the upper end of the casing immediately below the top wall 20 with the insert 90 gripping the wires 88 in a manner to relieve any strain or force exerted on the electric wires, so that such force will not be exerted on the connections between the wires and the terminals on the switches and solenoids thereby providing for more dependable operation and less chance of inadvertent disconnection of an electric wire from a terminal which can occur when bending or tension forces are exerted on the electric wires, such as when the wires extend directly to the switches and frequently are subjected to bending, twisting, and tension forces during installation and during normal use.

The optional orientation of the solenoids illustrated in the embodiment of FIGS. 1–4 and 5–7, respectively, enable the electric strike to be installed in metal jamb door frames or wood jamb door frames, and enable the strike to be installed in standard size cut outs provided in the door frame. The optional fail-safe arrangements illustrated in FIGS. 4 and 7, respectively, enable installation of the strike in orientations where it is necessary or desired for the electric strike to be released upon deenergization of the solenoids either deliberately or by power supply failure. The matching arcuate curvature and the inclination of the surfaces 46 and 48 reduce wear as the curvature of the surfaces generally coincide with the path of movement of the end of the locking cam 40 and the inclination of the surfaces prevents "walking" disengagement of these surfaces by exerting pressure on the keeper and thus on the locking lever while tapping, striking or banging the strike, door, door frame, or adjacent surfaces, thereby providing a dependable and secure electric strike.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An electric strike comprising a casing, a keeper movably mounted with respect to said casing and including an abutment portion movable in a predetermined path, a locking member movably supported with respect to said casing and movable from a position in the path of movement of the abutment portion to block movement of the keeper to a position out of the path of movement of the abutment portion to permit movement of the keeper, a locking cam being pivotally supported with respect to the casing and including a surface thereon engaging a surface on the locking member to prevent movement of the locking member when the surfaces are engaged, electrically operated means operatively associated with said cam for moving the cam to a position with the surface thereon disengaged from the surface on the locking member to enable movement of the locking member to a position out of the path of movement of the abutment portion on the keeper, said surfaces on the locking cam and locking member being arcuately curved in an arc generally coinciding with the arcuate movement of the locking cam in a manner that force exerted on the locking member by force exerted on the keeper will move the surfaces on the locking member and locking cam towards more effective engagement rather than toward disengagement, said locking member being in the form of a pivotal lever having an arcuate surface formed on the swinging end thereof for engagement by the curved surface on the locking cam for reducing wear on the surfaces during relative movement therebetween, said electrically operated means including a solenoid having an extendible and retractable core, said locking cam being spring biased in one pivotal direction whereby operation of the solenoid will overcome the spring bias to move the locking cam in the opposite direction, said locking cam being spring biased into engagement with the locking lever, said locking cam including a plate thereon having a transverse pin projecting therefrom, said solenoid core including a yoke having a laterally opening slot engaged wth said pin so that upon longitudinal movement of the core in response to energization of the solenoid, the locking cam will be disengaged from the locking lever.

2. An electric strike comprising a casing, a keeper movably mounted with respect to said casing and including an abutment portion movable in a predetermined path, a locking member movably supported with respect to said casing and movable from a position in the path of movement of the abutment portion to block movement of the keeper to a position out of the path of movement of the abutment portion to permit movement Of the keeper, a locking cam being pivotally supported with respect to the casing and including a surface thereon engaging a surface on the locking member to prevent movement of the locking member when the surfaces are engaged, electrically operated means operatively associated with said cam for moving the cam to a position with the surface thereon disengaged from the surface on the locking member to enable movement of the locking member to a position out of the path of movement of the abutment portion on the keeper, said surfaces on the locking cam and locking member being arcuately curved in an arc generally coinciding with the arcuate movement of the locking cam in a manner that force exerted on the locking member by force exerted on the keeper will move the surfaces on the locking member and locking cam towards more effective engagement rather than toward disengagement, said locking member being in the form of a pivotal lever having an arcuate surface formed on the swinging end thereof for engagement by the curved surface on the locking cam for reducing wear on the surfaces during relative movement therebetween, said electrically operated means including a solenoid having an extendible and retractable core, said locking cam being spring biased in one pivotal direction whereby operation of the solenoid will overcome the spring bias to move the locking cam in the opposite direction, said locking cam being spring biased out of engagement with the locking lever, said locking cam including a generally flat surface thereon spaced from the pivot axis, said core including an end portion engaging the flat surface and moving the locking cam into engagement with the locking lever upon energization of the solenoid thereby providing a fail-safe arrangement so that deenergization of the solenoid will release the keeper.

3. An electric strike comprising a casing, a keeper movably mounted with respect to said casing and including an abutment portion movable in a predetermined path, a locking member movably supported with respect to said casing and movable from a position in the path of movement of the abutment portion to block movement of the keeper to a position out of the path of movement of the abutment portion to permit movement of the keeper, a locking cam being pivotally supported with respect to the casing and including a surface thereon engaging a surface on the locking member to prevent movement of the locking member when the surfaces are engaged, electrically operated means operatively associated with said cam for moving the cam to a position with the surface thereon disengaged from the surface on the locking member to enable movement of the locking member to a position out of the path of movement of the abutment portion on the keeper, said surfaces on the locking cam and locking member being arcuately curved in an arc generally coinciding with the arcuate movement of the locking cam in a manner that force exerted on the locking member by force exerted on the keeper will move the surfaces on the locking member and locking cam towards more effective engagement rather than toward disengagement, said locking member being in the form of a pivotal lever having an arcuate surface formed on the swinging end thereof for engagement by the curved surface on the locking cam for reducing wear on the surfaces during relative movement therebetween, said electrically operated means including a solenoid having an extendible and retractable core, said locking cam being spring biased in one pivotal direction whereby operation of the solenoid will overcome the spring bias to move the locking cam in the opposite direction, said casing being in the form of a one-piece casting, said solenoid being mounted vertically at one end of the casing with the core extending longitudinally into the casing and being generally in longitudinal alignment with the engaging surfaces on the locking lever and locking cam.

4. An electric strike comprising a casing, a keeper movably mounted with respect to said casing and including an abutment portion movable in a predetermined path, a locking member movably supported with respect to said casing and movable from a position in the path of movement of the abutment portion to block movement of the keeper to a position out of the path of movement of the abutment portion to permit movement of the keeper, a locking cam being pivotally supported with respect to the casing and including a surface thereon engaging a surface on the locking member to prevent movement of the locking member when the surfaces are engaged, electrically operated means operatively associated with said cam for moving the cam to a position with the surface thereon disengaged from the surface on the locking member to enable movement of the locking member to a position out of the path of movement of the abutment portion on the keeper, said surfaces on the locking cam and locking member being arcuately curved in an arc generally coinciding with the arcuate movement of the locking cam in a manner that force exerted on the locking member by force exerted on the keeper will move the surfaces on the locking member and locking cam towards more effective engagement rather than toward disengagement, said locking member being in the form of a pivotal lever having an arcuate surface formed on the swinging end thereof for engagement by the curved surface on the locking cam for reducing wear on the surfaces during relative movement therebetween, said electrically operated means including a solenoid having an extendible and retractable core, said locking cam being spring biased in one pivotal direction whereby operation of the solenoid will overcome the spring bias to move the locking cam in the opposite direction, said casing being in the form of a one-piece casting, said solenoid extending laterally from the lower side wall of the casing with the core extending therethrough and oriented generally in perpendicular relation to the pivotal axis of the keeper.

5. The structure as defined in claim 4 wherein said locking cam is spring biased into engagement with the locking lever, said locking cam including a generally flat surface thereon spaced from the pivot axis, said core including an end portion engaging the flat surface and moving the locking cam out of engagement with the locking lever upon energization of the solenoid.

6. The structure as defined in claim 4 wherein said locking cam is spring biased out of engagement with the locking lever, said locking cam including a plate thereon having a transverse pin projecting therefrom, said solenoid core including a yoke having a laterally opening slot engaged with said pin so that upon longitudinal movement of the core in response to energization of the solenoid, the locking cam will be engaged with the locking lever.

7. An electric strike comprising a casing, a keeper movably mounted with respect to said casing and including an abutment portion movable in a predetermined path, a locking lever pivotally supported in depending relation from a horizontal pivot pin in said casing and swingable from a position in the path of movement of the abutment portion to block movement of the keeper to a position out of the path of movement of the abutment portion to permit movement of the keeper, the lower end of the lever including a notch therein with the edge of the notch extending along the longitudinal axis of the lever having a convex arcuate surface with an upper end disposed laterally inwardly from the side edge of the lever having the notch thereon a greater distance than the lower end of the notch, a locking cam pivotally supported from a horizontal pin in the casing and including an arm underlying the lower end of the lever with the free end of the arm having an upwardly extending hook-shaped projection thereon extending into the notch and provided with a concave arcuate surface thereon engaging the convex arcuate surface on the locking lever to prevent movement of the locking lever when the surfaces are engaged, electrically operated means operatively associated with said cam for permitting the cam to move to a position with the concave surface thereon disengaged from the convex surface on the locking lever to enable movement of the locking lever to a position out of the path of movement of the abutment portion on the keeper, said arcuate surfaces on the locking cam and locking lever being disposed in a plane in inclined relation between the pivot pins and slanted upwardly toward the abutment portion of the keeper whereby force exerted on the locking lever by the keeper will cam the surfaces on the locking lever and locking cam into engagement.

* * * * *